US009528286B2

(12) United States Patent
Wheatley

(10) Patent No.: US 9,528,286 B2
(45) Date of Patent: Dec. 27, 2016

(54) SYSTEM AND METHOD OF CONCRETE CRACK REPAIR

(71) Applicant: Donald E. Wheatley, Ann Arbor, MI (US)

(72) Inventor: Donald E. Wheatley, Ann Arbor, MI (US)

( * ) Notice: Subject to any disclaimer, the term of this patent is extended or adjusted under 35 U.S.C. 154(b) by 756 days.

(21) Appl. No.: 13/681,661

(22) Filed: Nov. 20, 2012

(65) Prior Publication Data

US 2014/0137503 A1 May 22, 2014

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04G 23/02*** | (2006.01) |

(52) U.S. Cl.

CPC ..... *E04G 23/0211* (2013.01); *E04G 23/0214* (2013.01); *E04G 23/0203* (2013.01); *E04G 23/0207* (2013.01); *E04G 2023/0251* (2013.01)

(58) Field of Classification Search

CPC ..... E04G 23/0211; E04G 23/0203; E04G 23/0214; E04G 23/0207; E04G 2023/0251

USPC ..... 52/309.5, 309.16, 309.17, 742.16, 52/742.12, 514, 514.5, 742.14, 742.1; 404/75; 428/40.1

See application file for complete search history.

(56) References Cited

U.S. PATENT DOCUMENTS

| | | | | |
|---|---|---|---|---|
| 3,532,316 | A * | 10/1970 | Mathes | 248/205.3 |
| 4,352,262 | A * | 10/1982 | Edelmann | E04G 23/0203 138/125 |
| 4,360,994 | A * | 11/1982 | Hodges | 52/742.16 |
| 4,507,013 | A * | 3/1985 | Martinak | 404/75 |
| 4,509,884 | A * | 4/1985 | Trout et al. | 405/269 |
| 5,309,692 | A * | 5/1994 | Hayashi et al. | 52/742.14 |
| 5,329,740 | A * | 7/1994 | Hayashi et al. | 52/514 |
| 5,476,340 | A * | 12/1995 | Contrasto | 404/75 |
| 5,649,398 | A * | 7/1997 | Isley et al. | 52/309.17 |
| 5,809,736 | A * | 9/1998 | Naito et al. | 52/742.14 |
| 6,312,541 | B1 * | 11/2001 | Hemphill | 156/95 |
| 6,532,714 | B1 * | 3/2003 | Ferm et al. | 52/742.12 |
| 6,692,595 | B2 | 2/2004 | Wheatley et al. | |
| 6,746,741 | B2 * | 6/2004 | Wheatley | 428/40.1 |
| 2009/0081913 | A1 | 3/2009 | Wheatley | |
| 2009/0263572 | A1 | 10/2009 | Wheatley | |

* cited by examiner

*Primary Examiner* — Chi Q Nguyen

(74) *Attorney, Agent, or Firm* — Harness, Dickey & Pierce, P.L.C.

(57) ABSTRACT

A method and system for repairing a crack in a concrete structure is provided including securing a plurality of ports at spaced intervals along the crack, adhering a carbon fiber panel to the concrete structure over the top of a crack, and injecting epoxy into each of the plurality of ports to fill the crack while the adhered carbon fiber panel seals the injected epoxy within the crack to provide a reliable epoxy-filled crack repair process.

13 Claims, 4 Drawing Sheets

SYSTEM AND METHOD OF CONCRETE CRACK REPAIR

FIELD

The present disclosure relates to a system and method of concrete crack repair.

BACKGROUND

This section provides background information related to the present disclosure which is not necessarily prior art.

Over time, concrete structures can develop cracks due to stresses and strains applied to the concrete structure. For purposes of this disclosure, cracks refer to cracks that occur in failed concrete as opposed to joints that are purposefully formed between separate concrete structures. It has been known to repair cracks in concrete by pasting over the cracks with a paste-over material and to secure injection ports over top of the crack. An epoxy or a urethane foam is injected through the injection ports. The paste-over material can be peeled off at the completion of a crack injection job by pulling on starter tabs placed under the lead edge surface at the time of application, or by prying under the paste-over material. The problem with the paste-over material is that the paste-over material can be thin or weak in some areas and can lead to leakage of the injected epoxy so that a good and complete injection of the epoxy is not achieved.

SUMMARY

This section provides a general summary of the disclosure, and is not a comprehensive disclosure of its full scope or all of its features.

The present disclosure provides a method of repairing a crack in a concrete structure including securing a plurality of ports at spaced intervals along the crack. A carbon fiber panel is then adhered to the concrete structure over the crack between the plurality of ports. Epoxy is then injected into each of the plurality of ports to fill the crack while the adhered carbon fiber panel provides a reliable exterior seal to prevent the injected epoxy from leaking out of the crack.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 2 is a perspective view similar to the view of FIG. 1 showing a carbon fiber panel adhered to the concrete structure over top of the crack with the injection ports extending there between;

Corresponding reference numerals indicate corresponding parts throughout the several views of the drawings.

DETAILED DESCRIPTION

Figure 1:
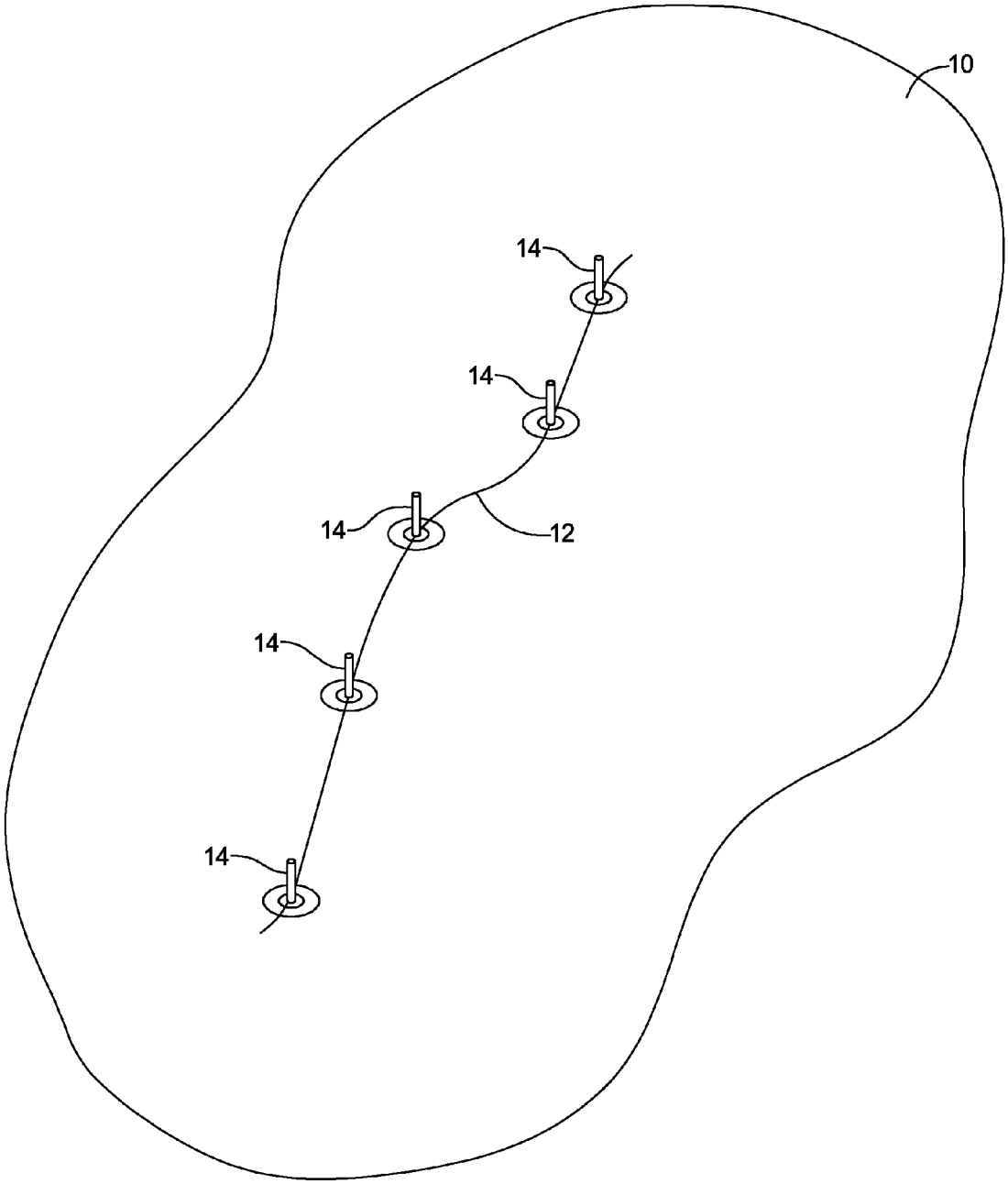
FIG. 1 is a partial perspective view of a concrete structure having a crack with a plurality of ports adhered in communication with the crack according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
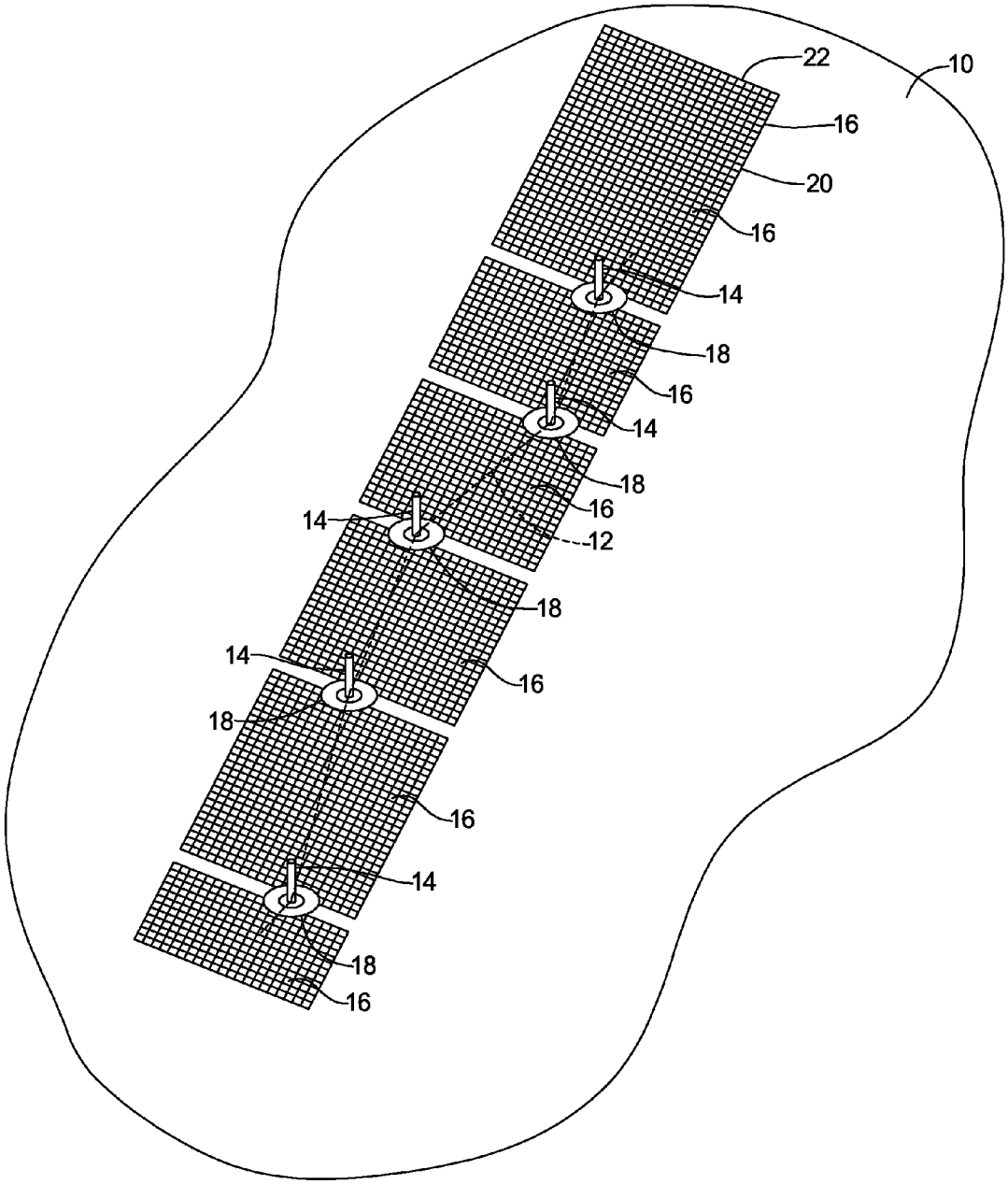
Figure 3:
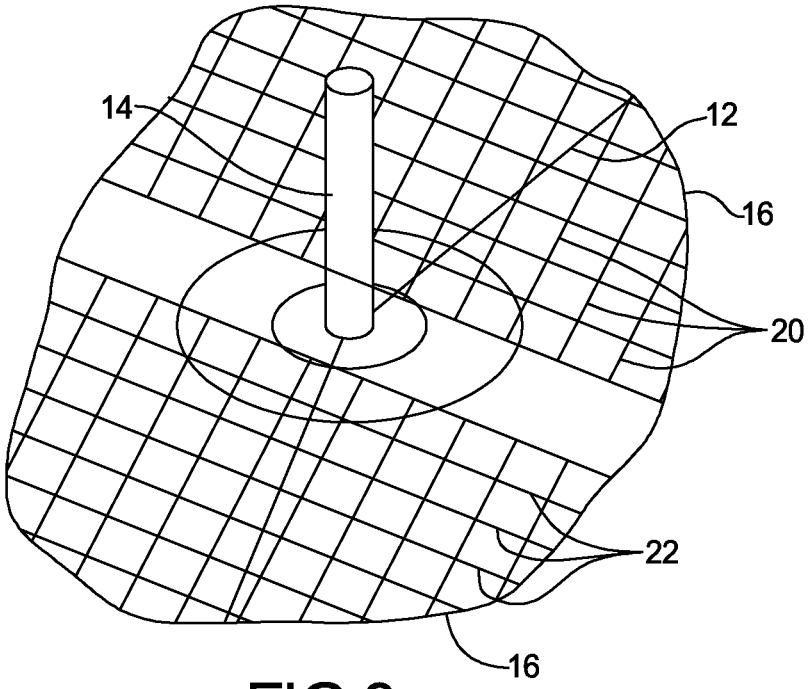
FIG. 3 is a close-up perspective view of an injection port disposed over top of the crack with the carbon fiber panel disposed thereon.
Figure 4:
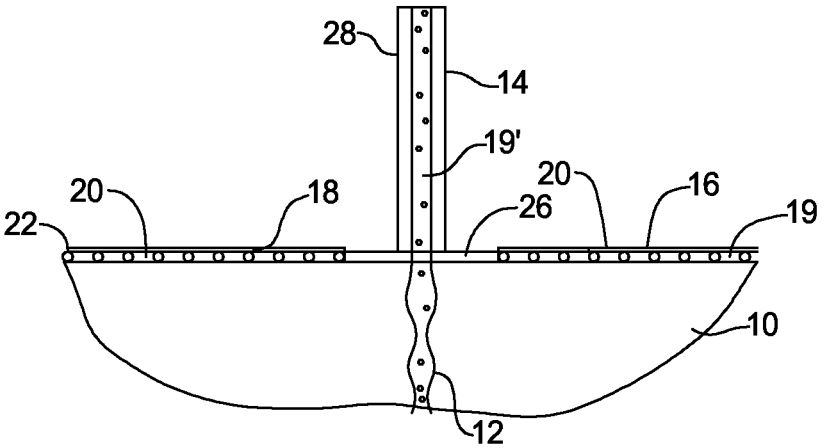
FIG. 4 is a cross-sectional view taken along line 4-4 of FIG. 3 illustrating the injection port disposed over top of the crack with the carbon fiber panel sealingly adhered over top of the crack.
Figure 5:
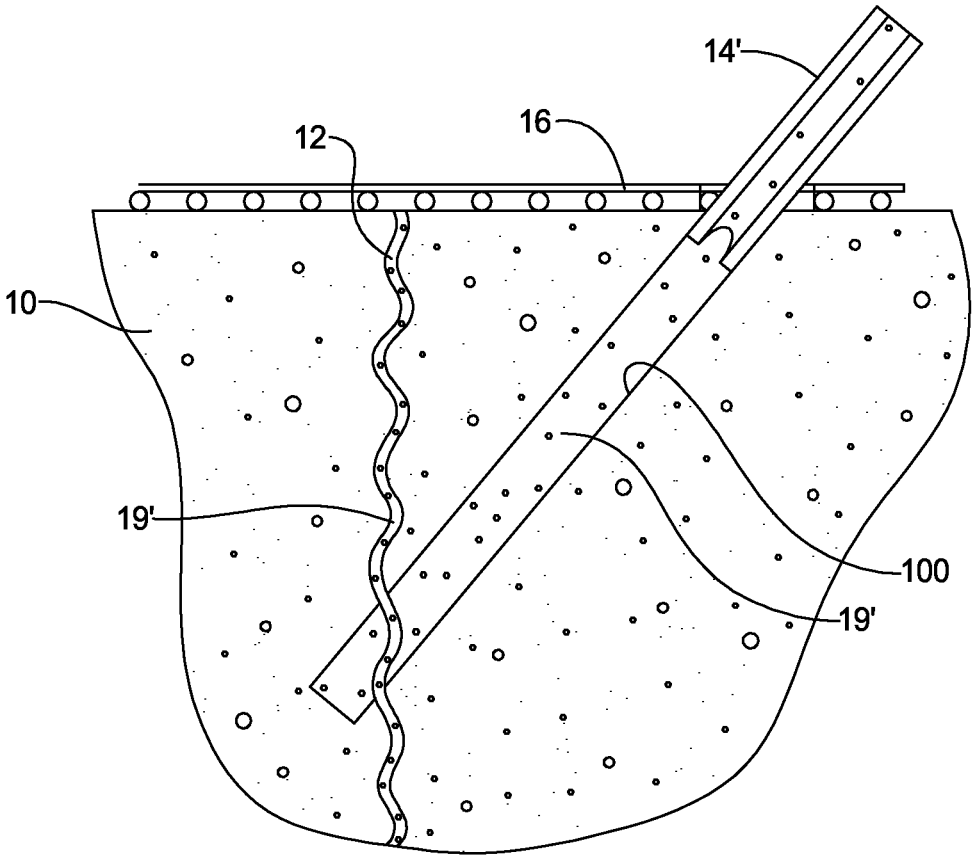
FIG. 5 is a cross-sectional view illustrating a drilled passage communicating with the crack.

With reference to FIG. 1, a concrete structure 10 is shown having a crack 12 extending in the surface thereof. According to the principles of the present disclosure, a plurality of injection ports 14 are adhered, or otherwise affixed, to the concrete structure 10 over top of the crack 12, or otherwise in communication with the crack, at predetermined spaced intervals such as, but not limited to, eight to twelve inches. It is anticipated that a drilled passage 100 intercepting the crack 12 is an alternative way of communicating a port 14' to the crack. The ports 14 can each include a base portion 26 and an elongated tube portion 28. Alternatively, the ports 14' can be tapped into a drilled hole 100. As illustrated in FIG. 2, a carbon fiber panel 16 is placed over top of the crack 12. The carbon fiber panel 16 can be provided with a plurality of holes 18 that can be punched or otherwise cut through the grid in the location of the ports 14 so that the carbon fiber panel 16 overlays the surface of the concrete structure 10 in a flat orientation with the ports 14 extending therethrough. Alternatively, the carbon fiber panels 16 can be cut to a length corresponding to a distance between the ports 14. The carbon fiber panel(s) 16 can then be adhered to the concrete structure 10 utilizing a thick viscous epoxy or other adhesive 19 so as to fully cover the crack 12 between the ports 14.

After the coating of epoxy or other adhesive 19 has fully cured, an epoxy 19' can be injected into each one of the ports 14 in order to fill the crack 12. According to one methodology, epoxy 19' can be injected into the lowermost port 14 until the epoxy 19' fills the crack 12 and becomes visible at the next higher port 14. Epoxy 19' is then injected into that next higher port 14 until the epoxy 19' becomes visible at the next highest port 14 therefrom. This process is repeated until injection into all of the ports is complete and the crack 12 is completely filled. After completion of the injection process, the ports 14 can be trimmed to remove the elongated tube portion 28 from the base 26 so that only the base portion 26 remains. The carbon fiber panel 16 can remain on the wall surface to continue to provide reinforcement to the concrete structure 10.

The carbon fiber panel 16 can be provided with a plurality of longitudinal carbon fiber bundles 20 and a plurality of transverse carbon fiber bundles 22 that can be tightly spaced next to each other or spaced apart from adjacent bundles by a predetermined distance such as ¼ inch while other spacings could also be utilized. The carbon fiber panel 16 can be coated with an epoxy that cures to rigidify the carbon fiber panel 16. The carbon fiber panel 16 can take on other alternative forms including non-woven transverse carbon fibers that are held together by an epoxy, or as a knitted or woven fabric structure that can be coated or un-coated by an epoxy or resin.

The carbon fiber panel 16 can be disposed over the crack 19 so that the transverse carbon fiber bundles 20 or other transverse carbon fibers are generally oriented to bridge the crack 12. In some applications, it may be desirable to orient the transverse carbon bundles or other fibers perpendicular to the crack 12 or at angles of between 90 and 45 degrees relative to the crack. It should be understood that because a crack 12 can often have an irregular non-linear shape, the carbon fiber grid 16 is placed over the crack 12 in a manner that best provides the desired general orientation of the transverse carbon fiber bundles 20 or carbon fibers relative to the crack 12.

It is noted that the method of the present disclosure can be utilized on various concrete structures including concrete walls, swimming pools, road surfaces, bridge structures, concrete pillars, and beams. The crack 12 that is fully covered and coated by the adhered carbon fiber panel 16 and epoxy coating protects the area around the crack from infiltration by water, thereby further enhancing the protection provided by the crack repair process.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of repairing a crack in a concrete structure, comprising:

drilling a plurality of holes in communication with the crack;

securing a plurality of ports at spaced intervals in communication with the plurality of drilled holes in communication with the crack;

adhering a fiber reinforced fabric to the concrete structure overtop of the crack using an adhesive; and injecting a hardenable liquid into one or more of said plurality of ports to fill the crack.

2. The method according to claim 1, wherein the fiber reinforced fabric includes a plurality of transverse carbon fibers that extend across the crack.

3. The method according to claim 2, wherein the fiber reinforced fabric includes a plurality of longitudinal carbon fiber bundles that extend across the crack.

4. The method according to claim 3, wherein the step of adhering includes filling spaces between the plurality of transverse carbon fiber bundles and the plurality of longitudinal carbon fiber bundles with the adhesive.

5. The method according to claim 1, wherein the fiber reinforced fabric includes a plurality of carbon fibers that are adhered together by an epoxy.

6. The method according to claim 1, wherein said injecting said hardenable liquid into each of said plurality of ports includes sequentially injecting epoxy into one of said plurality of ports until epoxy begins to enter an adjacent one of said plurality of ports.

7. The method according to claim 1, wherein said plurality of ports include a tube portion extending from a base portion, said tube portion including a passage therethrough that communicates with the crack.

8. The method according to claim 1, wherein the step of adhering a fiber reinforced fabric to the concrete structure overtop of the crack using an adhesive includes adhering the fiber reinforced fabric overtop of the crack between the ports.

9. A repaired concrete structure, comprising:

a concrete structure having a crack therein;

a plurality of ports affixed to the concrete structure at spaced intervals along the crack wherein the plurality of ports communicate with the crack through a drilled hole;

a fiber reinforced fabric adhered to the concrete structure overtop of the crack by an adhesive; and a hardenable liquid introduced through one or more of said plurality of ports to fill the crack.

10. The repaired concrete structure according to claim 9, wherein the fiber reinforced fabric includes a plurality of transverse carbon fiber bundles that extend across the crack.

11. The repaired concrete structure according to claim 10, wherein the fiber reinforced fabric includes a plurality of longitudinal carbon fiber bundles that extend generally parallel to the crack.

12. The repaired concrete structure according to claim 11, wherein the adhesive fills spaces between the plurality of transverse carbon fiber bundles and the plurality of longitudinal carbon fiber bundles.

13. The repaired concrete structure according to claim 9, wherein said plurality of ports include a tube portion extending from a base portion, said tube portion including a passage therethrough that communicates with the crack.

* * * * *